United States Patent [19]

Nagy et al.

[11] Patent Number: 4,742,321

[45] Date of Patent: May 3, 1988

[54] MOLDED CASE CIRCUIT BREAKER WITH ACCESSORY FUNCTIONS

[75] Inventors: Joseph G. Nagy, Hartford; Richard E. Bernier, Watertown; Gregory T. DiVincenzo, Plainville, all of Conn.

[73] Assignee: General Electric Company, New York, N.Y.

[21] Appl. No.: 66,384

[22] Filed: Jun. 25, 1987

[51] Int. Cl.[4] ..... H01H 83/00

[52] U.S. Cl. ..... 335/20; 335/135

[58] Field of Search ..... 335/20, 135, 6

[56] References Cited

U.S. PATENT DOCUMENTS 3,720,892 3/1973 Britton ..... 335/135

4,297,663 10/1981 Seymour et al. ..... 335/20

*Primary Examiner*—H Broome

*Attorney, Agent, or Firm*—Richard A. Menelly; Walter C. Bernkopf; Fred Jacob

[57] ABSTRACT

A molded case circuit breaker includes accessory functions such as an auxiliary switch and a shunt trip device mounted within the circuit breaker cover. A stain relief assembly interfaces the accessory wires with the circuit breaker case and cover. The strain relief fixture prevents inadvertent or intentional displacement of the wires from the accessory devices.

11 Claims, 6 Drawing Sheets

MOLDED CASE CIRCUIT BREAKER WITH ACCESSORY FUNCTIONS

BACKGROUND OF THE INVENTION

A molded circuit breaker having an interchangeable operating mechanism to accommodate circuit breakers of differing ampere ratings is described in U.S. patent application Ser. No. 817,213 filed Jan. 8, 1986. The Application describes the arrangement of the operating mechanism with the circuit breaker trip unit and movable contact arm to separate circuit breaker contacts upon the occasion of an overcurrent condition through the contacts. This application is incorporated herein for purposes of reference.

U.S. patent application Ser. No. 061,244, filed Jun. 12, 1987 entitled "Molded Case Circuit Breaker Accessory Enclosure" describes an integrated circuit breaker having both overcurrent protection as well as at least one auxiliary accessory function. The circuit breaker accessory is contained in a recess formed within the circuit breaker cover. This Application is also incorporated herein for reference purposes.

When such accessory devices are mounted within a circuit breaker enclosure, separate wire conductors lead from the circuit breaker enclosure to a remote location. When the accessory function comprises an auxiliary switch or a shunt trip accessory, the separate wire conductors allow remote signal indication or remote tripping of the circuit breaker for test purposes. In order to prevent damage to both the accessory as well as the circuit breaker enclosure by intentional or inadvertent excess tension forces applied to the external wire conductors, some means of "strain relief" must be provided within the circuit breaker enclosure. A known means of reducing the effect of ordinary tension forces on an accessory mounted within a circuit breaker enclosure is to trap the wire conductors between the cover and case of the circuit breaker enclosure. When excessive tension force is applied to the wire conductors, the circuit breaker cover becomes damaged. The damage to the circuit breaker cover can seriously affect the integrity of the components contained within the circuit breaker case and hence result in a potentionally unsafe condition. The unsafe circuit breaker condition is not readily discovered when the wire conductors lead to a remote location out of sight of the circuit breaker itself.

One purpose of the instant invention accordingly, is to provide a strain relief mechanism that is mounted within the circuit breaker enclosure and which prevents excess tension forces on the wire conductors from damaging either the accessory or the circuit breaker enclosure.

SUMMARY OF THE INVENTION

A circuit breaker accessory unit mounted within a circuit breaker cover operatively interacts with the circuit breaker components. Wire conductors connect the accessory unit with an external device for either remote operation of the accessory unit or for signal indication of the circuit breaker contact status. A strain relief mechanism is formed on one of the accessory unit side frame supports to prevent damage to the accessory as well as the circuit breaker enclosure.

DESCRIPTION OF THE PREFERRED EMBODIMENT

Figure 1:
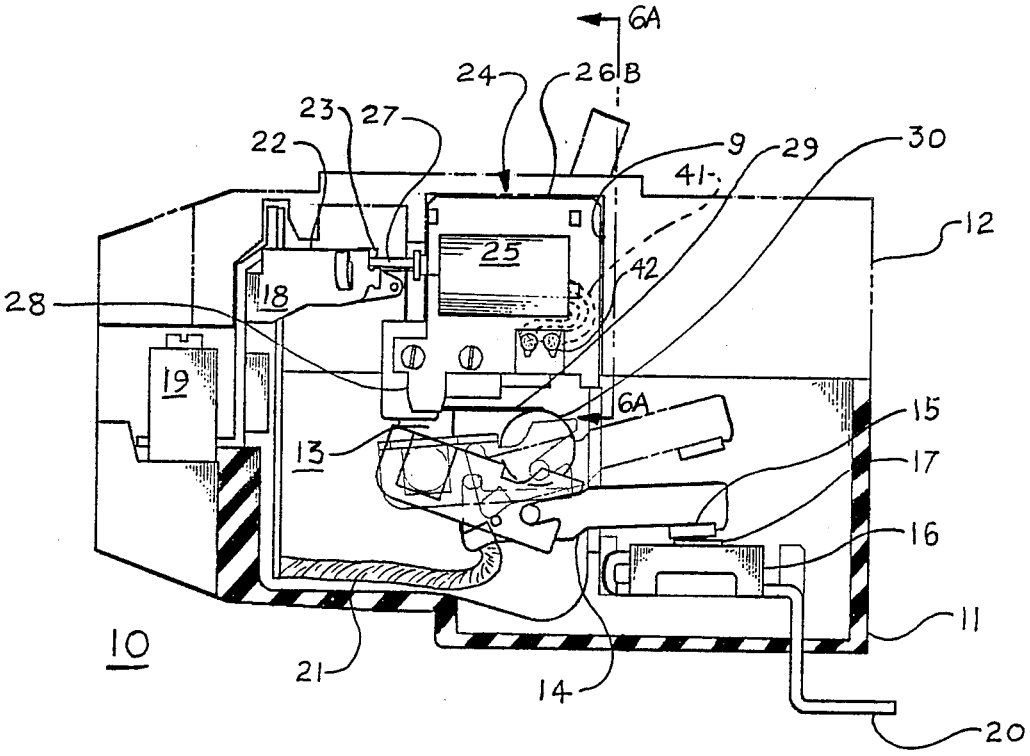
FIG. 1 is a side view of a molded case circuit breaker containing an accessory unit strain relief mechanism according to the invention.

A circuit breaker 10 is shown in FIG. 1 consisting of a case 11 within which are arranged an operating mechanism 13 operably connected with a movable contact arm 14 and crossbar 30 for disconnecting a movable contact 15 welded or brazed at one end thereof from a fixed contact 17 which is similarly attached to a fixed contact support 16. A trip unit generally shown at 18 connects between the load terminal 19 and the movable contact arm by means of a braided conductor 21 to articulate the operating mechanism upon the occurrence of an overcurrent condition through those circuit breaker components connecting between the load terminal 19 and the line terminal 20. A good description of the operating mechanism is found in the aforementioned U.S. patent application Ser. No. 817,213. The trip unit 18 includes a magnet 22 and a movable armature 23 which respond to overcurrent conditions to articulate the operating mechanism in the manner described earlier. A shunt trip accessory 24 which allows the circuit breaker to be tripped from a remote location is contained within a recess 9 formed in the circuit breaker cover 12, shown in phantom, and is arranged such that the plunger 27 extending from the solenoid 25 contacts the armature 23 to articulate the operating mechanism 13 when a voltage signal is applied across the wire conductors 41 which extend to a location remote from the circuit breaker. To provide strain relief to the wire conductors, a strain relief wire support 42 is attached to one of the side frames 26B which supports the shunt trip accessory 24 within the cover recess. Once the movable contact arm 14 moves to the tripped position indicated in phantom, and the movable and fixed contacts 15, 17 have completely separated, the movable contact arm strikes a flat spring 29 which forms part of a microswitch 28 located immediately subjacent the shunt trip accessory 24. The microswitch interrupts the voltage signal applied to the wire conductors to protect the solenoid 25 from overheating.

Figure 2:
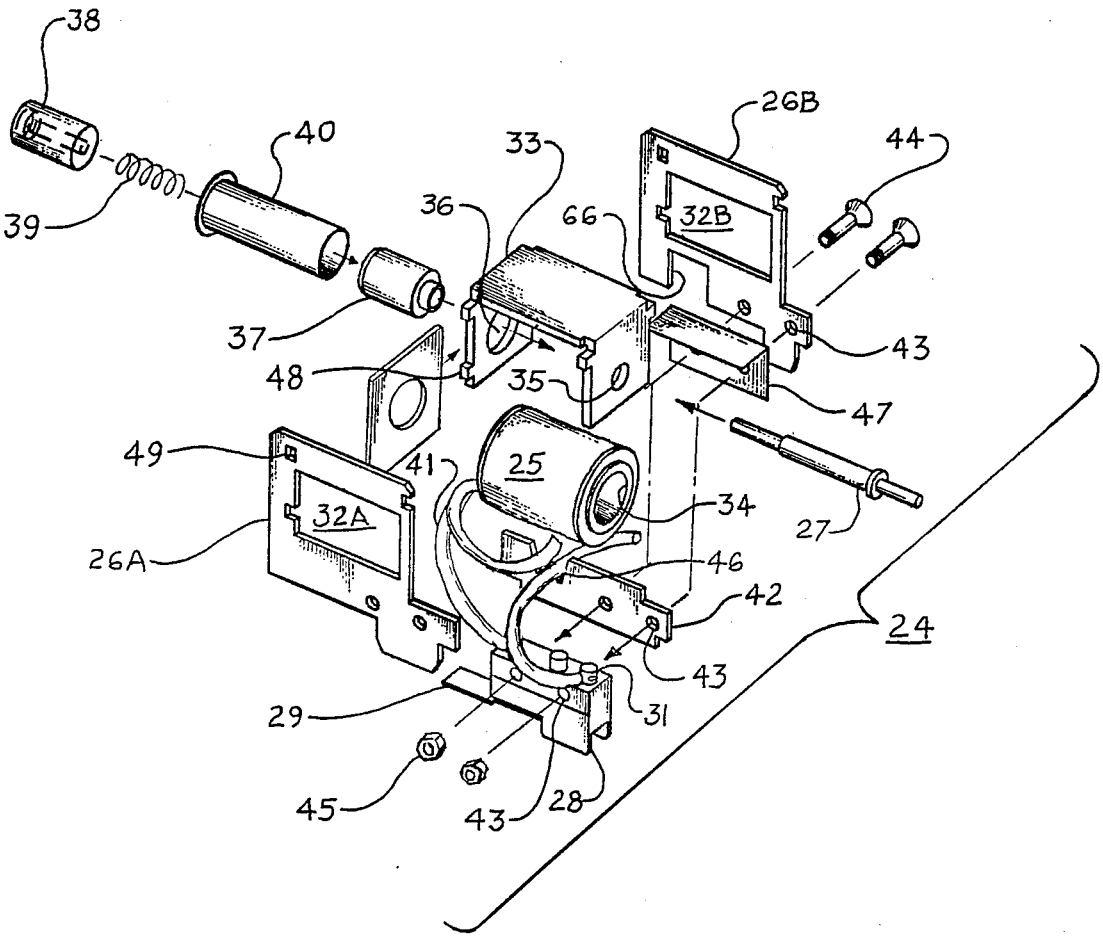
FIG. 2 is a top perspective view in isometric projection of a shunt trip accessory unit containing the strain relief mechanism of the invention.

The shunt trip accessory 24 is assembled in the manner depicted in FIG. 2. The solenoid 25 is arranged within a U-shaped coil support 33 having a small aperture 35 on one leg for passage of the solenoid plunger 27 with a larger aperture 36 on the opposite leg through which the stationary core 37, movable core 38, return spring 39 and sleeve 40 are inserted. The solenoid having an elongated aperture 34 is then positioned between a pair of side frames 26A, 26B having apertures 32A, 32B for allowing clearance to both sides of the solenoid when the side frames are attached to the U-shaped coil support 33 by means of tabs 48 extending from the U-shaped coil support through corresponding slots 49 formed in the side frames 26A, 26B. The wire conductors 41 are nested within V-shaped grooves 46 formed within the strain relief wire support 42 and are electrically connected with the microswitch 28 by means of terminal posts 31 extending from the top of the microswitch and pass through the wire access slot 66 formed on the bottom of side frame 26B. The flat spring 29 extends from the bottom surface of the microswitch for interfacing with the circuit breaker operating mechanism as described earlier. A fiber barrier 47 is positioned over the microswitch terminal posts 31 to electrically isolate the terminal posts. The side frames are then fastened together by means of elongated screws 44, clearance holes 43 and nuts 45.

Figure 3:
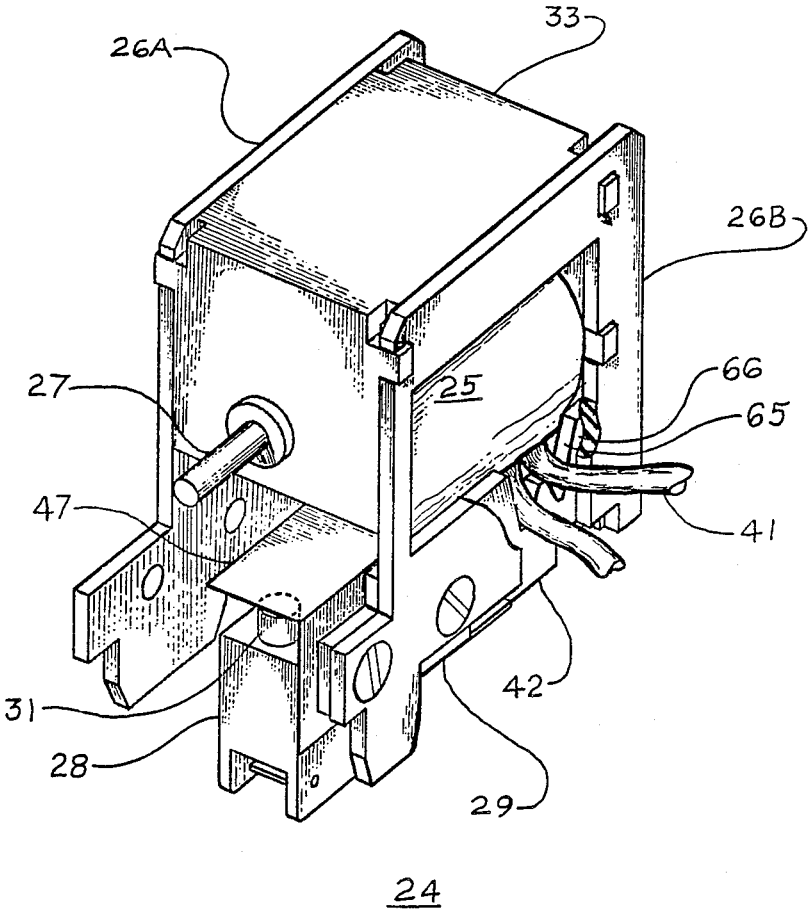
FIG. 3 is a top perspective view of the shunt trip accessory unit of FIG. 2 after assembly.

The assembled shunt trip accessory 24 prior to connecting within the circuit breaker 10 of FIG. 1 is shown in FIG. 3. The solenoid 25 is held within the coil support 33 and extends through the side frames 26A, 26B on both sides. The microswitch 28 together with the flat spring 29 extend beneath the lower surface of the side frames. The solenoid plunger 27 operatively extends from the same side of the solenoid as the terminal posts 31 to which one of the wire conductors 41 is connected. The terminal and wire conductor are in turn insulated by the fiber barrier 47. The wire conductors extend through the access slot 66 formed in side frame 26B and thence through the V-shaped grooves 65 formed within the strain relief wire support 42. The function of the V-shaped grooves 65 will be discussed below in greater detail.

Figure 4:
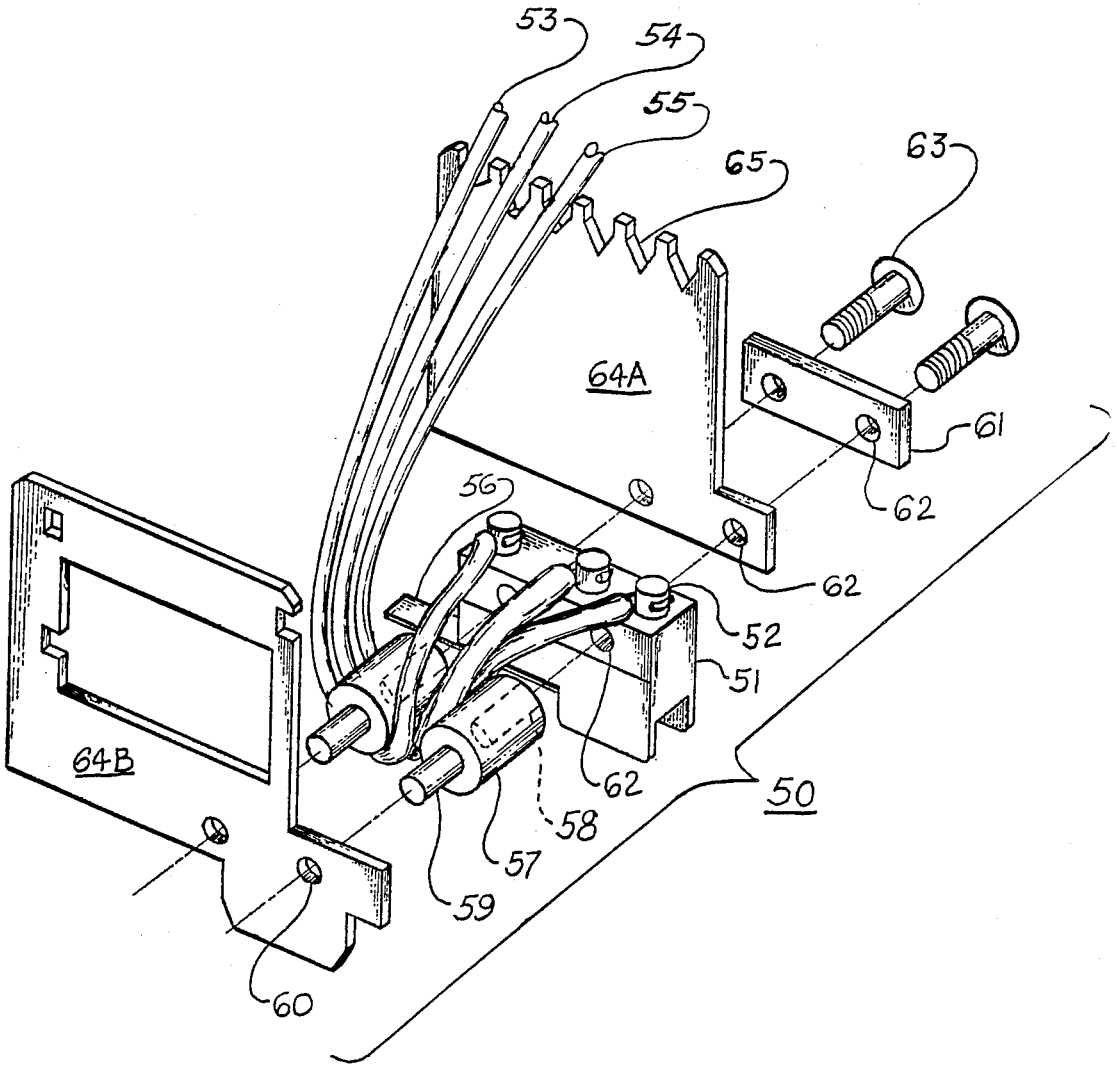
FIG. 4 is a top perspective view of an auxiliary switch accessory unit containing the strain relief mechanism of the invention.

In combination with the shunt trip element of FIG. 1, an auxiliary switch accessory 50 such as shown in FIG. 4 can be installed within a separate recess 9 in the circuit breaker cover 12. The auxiliary switch basically consists of a microswitch 51 which connects with a location remote from the circuit breaker by means of wire conductors 53—55 and terminal posts 52 on the top surface thereof. The microswitch is activated by means of a flat spring 56 extending from the bottom of the microswitch in a manner similar to that described earlier for interrupting the voltage signal to the shunt trip accessory 24 as shown in FIG. 1. The wire conductors 55 pass from the terminal posts 52, between a pair of cylindrical spacers 57 and thence through a plurality of V-shaped grooves 65 formed in the top surface of a side frame 64A. The function of the V-shaped grooves 65 is similar to those described earlier for the shunt trip accessory 24. The microswitch is attached to the side frame 64A by insertion of screws 63 through clearance holes 62 within a rectangular spacer 61 then through similar clearance holes 62 through the microswitch. The other side frame 64B is attached by inserting the screws 63 through internally threaded apertures 58 formed within the cylindrical spacers 57 and then inserting a pair of posts 59 formed on the cylindrical spacers 57 to within apertures 60 formed in the side frame 64B and forming over the ends of the posts.

Figure 5:
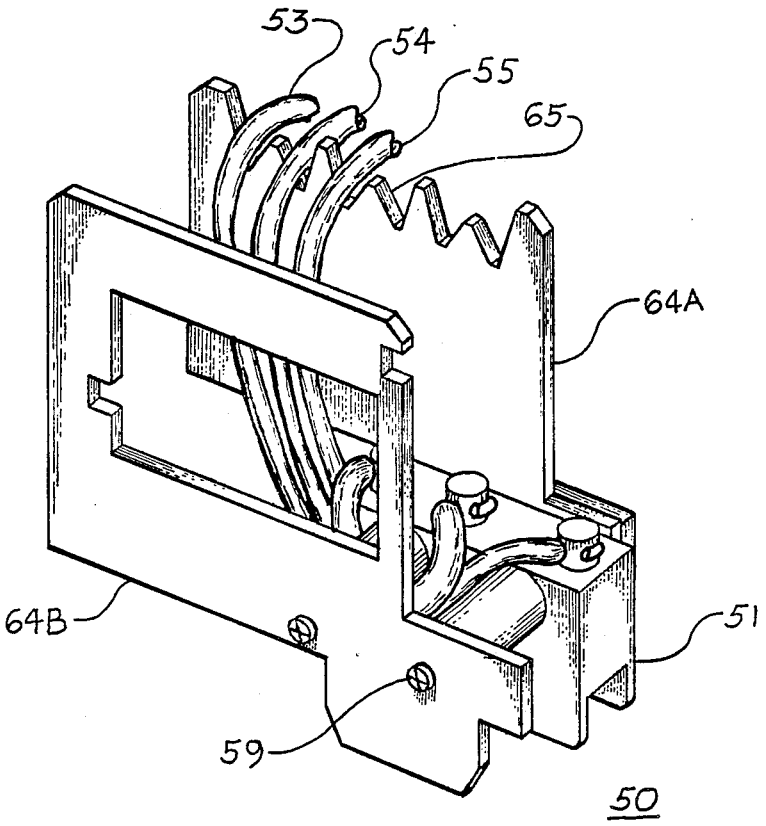
FIG. 5 is a front perspective view of the auxiliary switch accessory unit of FIG. 4 after assembly.

The assembled auxiliary switch 50 is shown in FIG. 5 prior to connecting within the circuit breaker 10 of FIG. 1. The assembled auxiliary switch 50 becomes a free standing accessory wherein the microswitch 51 is fixedly attached between the side frames 64A, 64B by means of the formed-over posts 59. The V-shaped grooves 65 are formed on the top of side frame 64A to retain the wire conductors 53–55 and to provide strain relief to the wire conductors.

Figure 6A:
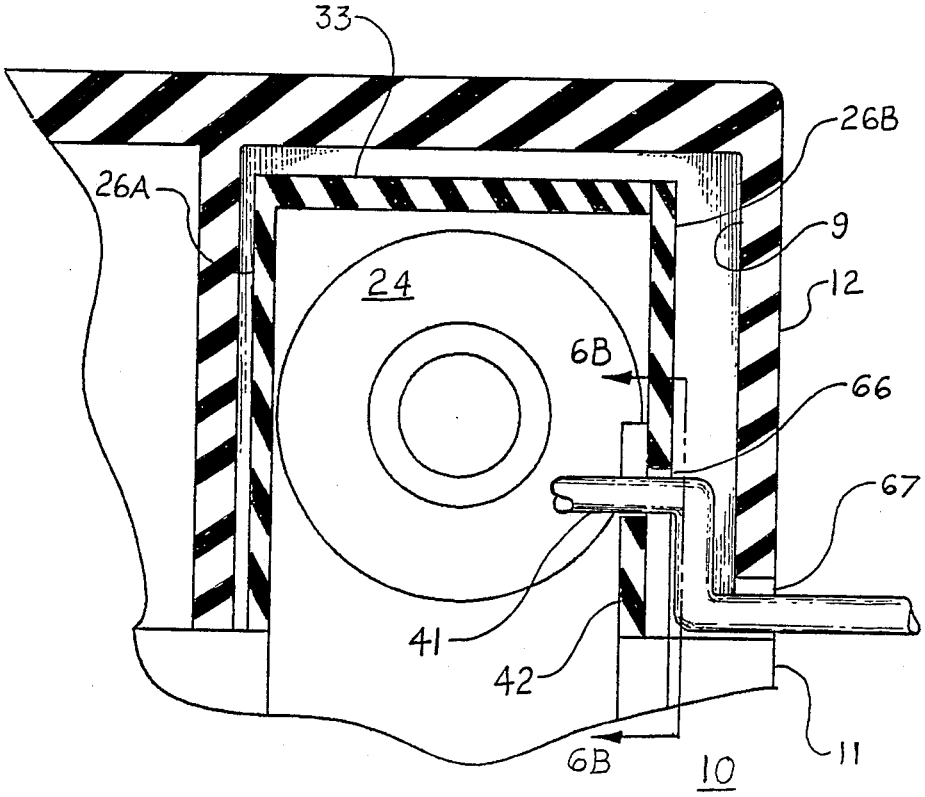
FIG. 6A is an enlarged end view in partial section of the molded case circuit breaker of FIG. 1; viewed through the 6A—6A plane.
Figure 6B:
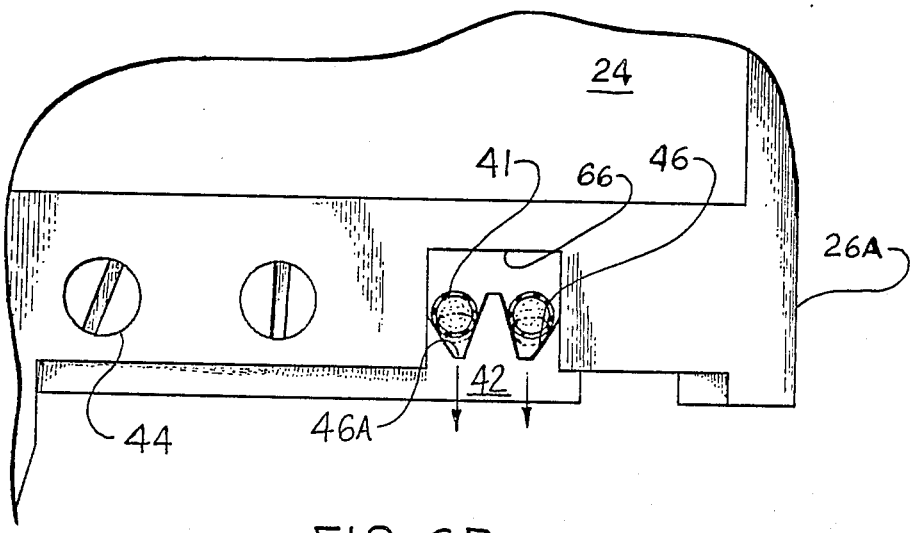
FIG. 6B is an enlarged side view in partial section of the accessory unit of FIG. 6A viewed through the 6B—6B plane.

The strain relief features of the invention can be best seen by referring now to FIGS. 6A and 6B. The strain relief wire support 42 used with the shunt trip accessory 24 is retained within the recess 9 formed in the cover 12 of the circuit breaker 10. The U-shaped coil support 33 in turn supports the side frames 26A and 26B as indicated. The wire conductor 41 passes over and is supported by the strain relief wire support 42 before passing through the wire access slot 66 formed in side frame 26B and thence through the clearance slot 67 formed in the circuit breaker cover 12 next to the circuit breaker case 11. It is noted that the wire conductor makes a right angle bend over the strain relief wire support 42 and thence an opposing right angle bend upon egress through the clearance slot 67. When a tension force is applied on the wire conductor in the direction indicated in FIG. 6A, a downward force becomes impressed upon the wire conductors as indicated in FIG. 6B. The downward force drives the wire conductors down into the V-shaped grooves 46 toward the slot apices 46A. The cross section of the wire conductors assumes an oval configuration as indicated in phantom as the force moves the wire conductors downwardly within the slots. This movement of the wire conductors 41 within the V-shaped grooves 46, substantially increases the frictional forces developed between the wire conductors 41 and the sides of the V-shaped slots 46 since more of the circumference of the wire conductor contacts the sides of the slots as more force is applied in the direction indicated in FIG. 6A. The screws 44 tightly hold the wire support 42 against the side frame 26A to prevent the wire support from moving under the increased applied force. It has been determined that the arrangement of the V-shaped grooves 46 on the strain relief wire support 42 enables the wire conductors to resist a substantially greater amount of tensile force than when the grooves are omitted altogether.

A circuit breaker having an accessory contained therein which is electrically accessed by means of wire conductors passing outside the circuit breaker to a remote distance has been described. Strain relief means are provided to prevent damage to the circuit breaker enclosure, the circuit breaker accessory and the wire conductors by means of a V-grooved wire support. The provision of the V-shaped grooves counters any tensile forces on the wires by increasing the frictional forces along the circumference of the wires to tightly hold the wires within the strain relief wire support.

Having thus described my invention, what I claim as new and desire to secure by Letters Patent is:

1. A circuit breaker and accessory unit comprising:

a molded plastic case and cover;

a pair of separable contacts within said case;

an operating mechanism within said case arranged for separating said contacts upon occurrence of an overload condition through said contacts;

a circuit breaker accessory mounted within said cover and arranged for separating said contacts upon command;

a wire conductor connecting with said accessory and passing outside said case and cover for providing external electrical access to said accessory; and a strain relief wire support within said case intermediate said accessory and said case for preventing damage to said accessory when tensile force is applied to said wire conductor said strain relief wire support comprising a planar member having a V-shaped groove therein.

2. The circuit breaker and accessory of claim 1 wherein said wire conductor is arranged within said groove.

3. The circuit breaker and accessory of claim 1 wherein said accessory comprises a shunt trip device supported between pair of side support frames.

4. The circuit breaker and accessory unit of claim 3 wherein said strain relief wire support is attached to one of said side support frames.

5. The circuit breaker and accessory unit of claim 1 wherein said accessory comprises a remote switch supported between a pair of side support frames.

6. The circuit breaker and accessory unit of claim 5 wherein said remote switch strain relief wire support comprises one of said side support frames.

7. The circuit breaker and accessory unit of claim 6 wherein said remote switch strain relief wire support comprises a V-shaped groove formed on a top surface of said one side support.

8. The circuit breaker and accessory unit of claim 5 wherein said one support frame includes an access slot for passage of said wire conductor.

9. A flux shifter circuit breaker accessory comprising:

a pair of support side frames;

an apertured solenoid intermediate said support frame;

an armature slidably arranged within said solenoid for becoming extended in response to electric signals applied to said solenoid;

a wire support member attached to one of said support frames, a top of one of said support frames being slotted; and a pair of led wires attached to said solenoid at one end thereof and arranged within said slots proximate said one end, whereby any force applied to an opposite end causes said lead wires to move downwards within said slots said slots comprising V-shaped grooves.

10. An auxiliary switch circuit breaker accessory comprising:

a pair of opposing side frames;

an electric switch intermediate said side frames and attached thereto; and a pair of lead wires attached to said electric switch at one end and extending within slots formed within a top surface of one of said side frames proximate said one end, whereby any force applied to an opposite end causes said lead wires to move downwards within said slots said slots comprising V-shaped grooves.

11. The auxiliary switch of claim 10 further including a pair of rollers, said lead wires being arranged between said rollers, intermediate said slots and said switch.

* * * * *